US005345055A

United States Patent [19]

Leung

[11] Patent Number: 5,345,055

[45] Date of Patent: Sep. 6, 1994

[54] FAST HEATING CURLING IRON AND CONTROL CIRCUIT THEREFOR

[75] Inventor: Kit L. T. Leung, Northpoint, Hong Kong

[73] Assignee: Conair Corporation, Stamford, Conn.

[21] Appl. No.: 91,919

[22] Filed: Jul. 14, 1993

[51] Int. Cl.[5] ..... H05B 1/02; H05B 3/00; A45D 1/00

[52] U.S. Cl. ..... 219/225; 219/546; 219/548; 219/542; 219/497; 219/501; 132/209; 132/227

[58] Field of Search ..... 219/225, 501, 497, 546, 219/548, 542, 222, 223, 240, 227, 505; 132/227, 269

[56] References Cited

U.S. PATENT DOCUMENTS

| | | | |
|---|---|---|---|
| 1,573,727 | 2/1926 | Magranis et al. | 219/546 |
| 1,665,619 | 4/1928 | Ackley | 219/222 |
| 1,720,865 | 7/1929 | Thompson | 219/222 |
| 3,247,358 | 4/1966 | Schmidt | 219/501 |
| 3,614,391 | 10/1971 | Lauck, III | 219/501 |
| 3,681,569 | 8/1972 | Schwarz | 219/501 |
| 4,085,309 | 4/1978 | Godel et al. | 219/501 |
| 4,486,915 | 12/1984 | Stewart et al. | 219/222 |
| 4,549,560 | 10/1985 | Andis | 219/222 |
| 4,625,738 | 12/1986 | Skovdal et al. | 219/222 |
| 4,851,641 | 7/1989 | Barowski et al. | 219/225 |

*Primary Examiner*—Mark H. Paschall
*Attorney, Agent, or Firm*—Haynes H. Johnson

[57] ABSTRACT

A rapidly heating curling iron with a handle, a hollow barrel secured to the handle, and a heating element positioned within the barrel, the heating element being an electrical insulating board wound with electrical wire. A pair of heat transmission members are positioned with one on each side of the heating element, but with electrical insulation between the heating element and the heat transmission members. The heat transmission member are shaped and dimensioned such that they fit between the electrical insulation and the inner surface of the barrel and press against a substantial portion of the inner surface, a temperature sensor positioned to sense the temperature of the barrel, and a control circuit allows the heating element to be energized only during one half cycle of supplied AC power, and adjusts the portion of the half cycle which is used in accordance with the sensed temperature.

10 Claims, 3 Drawing Sheets

FIG. 1.
(PRIOR ART)
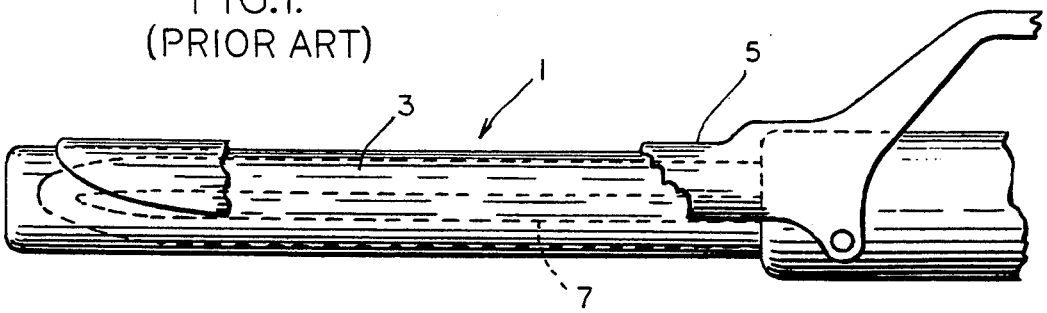
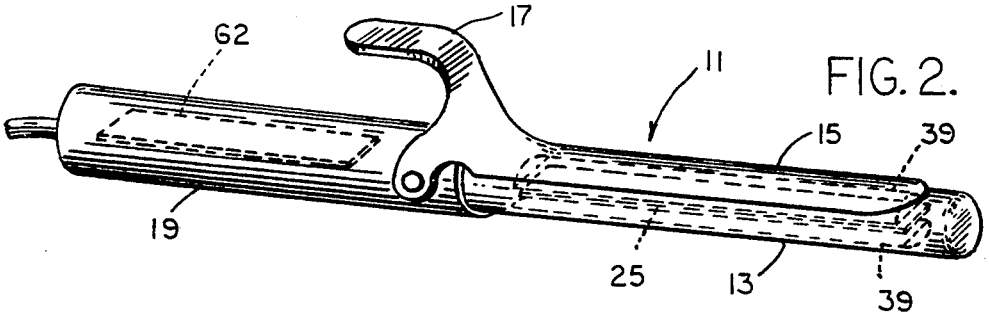
FIG. 2.
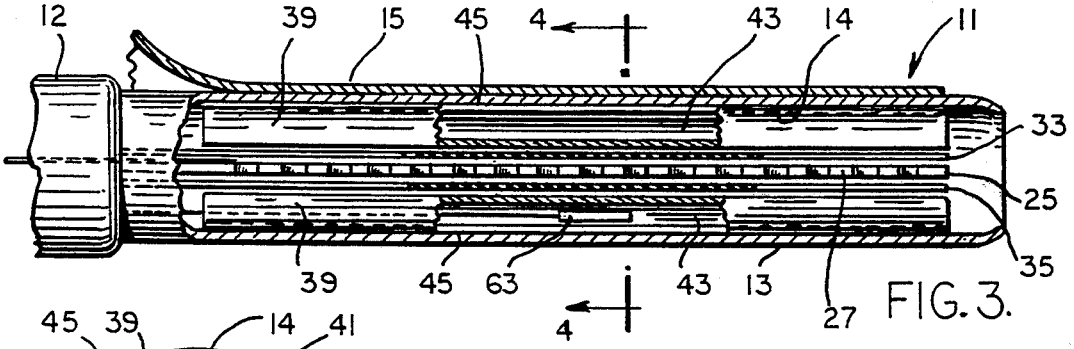
FIG. 3.
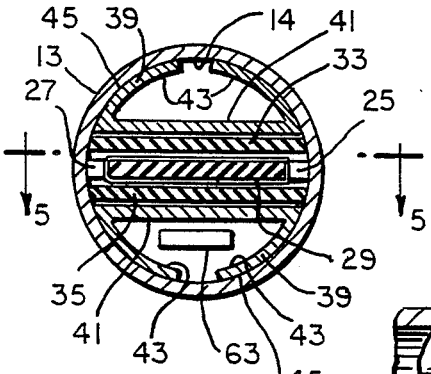
FIG. 4.
FIG. 5.
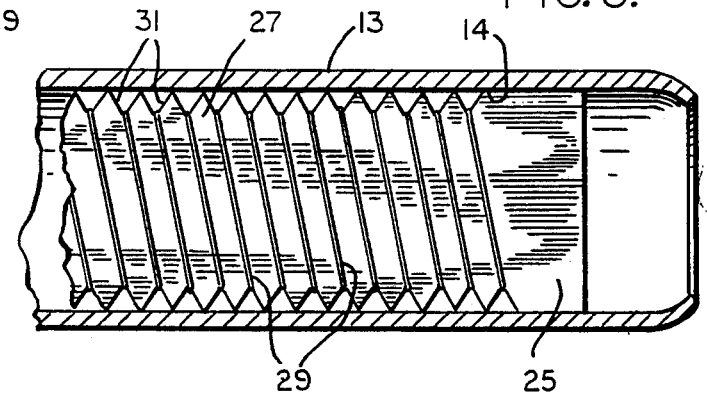

FAST HEATING CURLING IRON AND CONTROL CIRCUIT THEREFOR

FIELD OF THE INVENTION

This invention relates to personal care appliances and, in particular, to curling irons which heat up rapidly, but which are prevented from overheating during the heat up process.

BACKGROUND OF THE INVENTION

Many curling irons are heated by having rope heaters within their barrels. These normally operate at about ten to thirty watts and may require as long as five minutes to heat the barrel to working temperature. Efforts to increase this heating time by increasing the wattage can cause excessive internal temperature which can break down the rope heater and cause a shock hazard.

The present invention is a structure which provides for rapid heating without the possibility of breakdown.

BRIEF SUMMARY OF THE INVENTION

My invention provides for the use of a wire-wound mica board for a heating element which can withstand higher temperatures. This board is fitted within the barrel and positioned on a diameter of the barrel. A thin mica board electrical insulator is on each side of the heating element; and a heat transmission member having a generally semi-circular cross-section is pressed against each insulator.

The heat transmission member is dimensioned such that the outer surface of its arcuate portion fits against the inner surface of the curling iron barrel, thus providing good heat transmission from the heating element to the barrel. The result is that the curling iron heats faster because more power can be used and because there is faster heat transmissivity from the heating element to the barrel.

With rapid heating, however, the usual thermostatic temperature controls may not cut the power in time, resulting in thermal overshoot; and the curling iron them becomes too hot. To prevent this, I use a control circuit which cuts back on the power, by cutting off more of the phase, as the curling iron approaches the desired temperature.

DESCRIPTION OF THE DRAWINGS

FIG. 1 is a side elevation of a portion of a prior art curling iron. It uses a rope heater.

FIG. 2 is a perspective view of the curling iron of this invention.

FIG. 3 is a longitudinal section through the barrel of the curling iron.

FIG. 4 is a transverse section through the barrel, taken on line 4—4 of FIG. 3.

FIG. 5 is a longitudinal section through the barrel, transverse to the section of FIG. 3, taken on line 5—5 of FIG. 4.

DETAILED DESCRIPTION OF THE INVENTION

Figure 6:
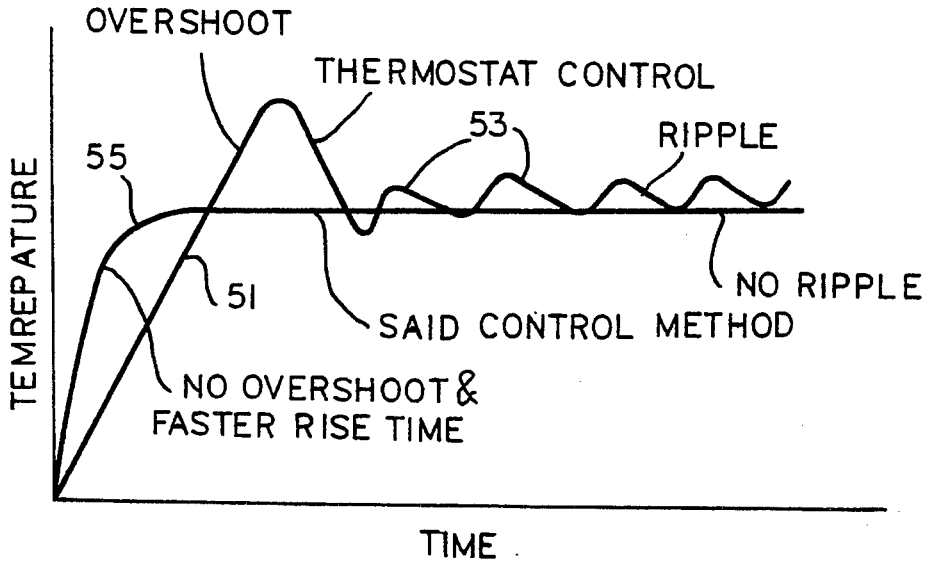
FIG. 6 is a graph showing temperature versus time for an overshoot heating and for heating using my control circuit.

Prior art curling irons 1 (FIG. 1) have the usual barrel 3 and clamp 5. The heating element is a rope heater 7. The rope heater has few points of contact with the inner surface 4 of the barrel and, consequently, transfers heat to the barrel slowly. Any effort to speed up heating of the curling iron by increasing the power consumption tends to cause the rope heater to burn out by melting its fiberglass sleeving, destroying the electrical insulating property of the sleeving.

By contrast, my new curling iron transmits heat energy more efficiently from the heating element to the barrel and can use more power. Consequently, the curling iron will heat up on about a minute or a minute and a half, instead of about five minutes, as in the prior art.

My curling iron 11 has the usual barrel 13, clamp 15 and associated thumbpiece 17, and handle 19. Its heating element 25 is different, being a mica heater. Element 25 has a mica board 27 wound with heating wire 29. The board 27 has a width approximating the inner diameter of barrel 13, so that it can be mounted within the barrel with its edges touching or proximate to the inner surface 14 of the barrel 13. Board 27 has sawtooth edges with notches 31 to receive the wire 29, preventing the wire 29 from reaching the edges and touching the barrel. This prevents a possible electrical hazard.

Mica insulating boards 33 and 35 are positioned with one on each side of the heating element 25 to provide electrical insulation. They are thin enough, however, so that they don't prevent thermal transmission through them of heat energy.

Two metal heat transmission members or heat sinks 39 are shaped and dimensioned to fit snuggly within the space between insulating boards 33 and 35 and the inner surface 14 of the barrel. These are preferably made of aluminum and have semi-circular cross-sections. Each member has a flat contact surface 41, coextensive with one insulating board, and a connected arcuate portion 43. The arcuate portions may be continuous or, as shown in FIG. 4, divided for ease in manufacturing. The arcuate portions have outer surfaces 45 shaped and dimensioned to fit against and in close contact with the inner surface 14 of barrel 13. The entire heating unit is held together with eyelets. When it is inserted into the barrel, the heat transmission members 39 are firmly pressed against the inner surface 14 of the barrel and against the insulating boards, and, so, hold the assembly in place and provide a good thermal conduction path to the barrel.

Thus, I have provided a curling iron which can utilize greater power and which can more efficiently transmit heat energy from its heating element to its barrel. As a result, the curling iron will heat itself quite rapidly.

A rapidly heating curling iron can, however, have problems with temperature control, since some controls do not prevent the temperature from overshooting, i.e., overheating after reaching the desired temperature. Normal controls make use of a thermostat as a temperature regulating device. When the required temperature is reached, it cuts off the power supply. When the operating temperature drops below the cut-off point, power again is supplied. Because of the delay of thermostatic response, the operating temperature is not steady, but ripples up and down. Use of this system in a fast heating curling iron results in overshoot and might damage the unit.

This overheating is shown graphically in FIG. 6 in which temperature is plotted against time. Curve 51 shows a typical overshooting temperature. As can be seen, the temperature goes above the desired temperature 57 and ripples 53 up and down (the power going off and on) before it begins to settle down at the desired temperature. By contrast, using my control circuit, one obtains a curve 55 which shows more rapid heating of the curling iron, with the temperature goingdirectly to the desired temperature 57 and staying there.

My control circuit 61 is on a printed circuit board 62 positioned within handle 19. It initially delivers full (half-wave) electrical power to the heating element. As the temperature rises, the circuit gradually decreases the amount of power supplied, thus avoiding an overshoot. When the temperature reaches the desired point, just enough power is delivered to maintain the temperature, and , so, ripples 53 are avoided.

Figure 7:
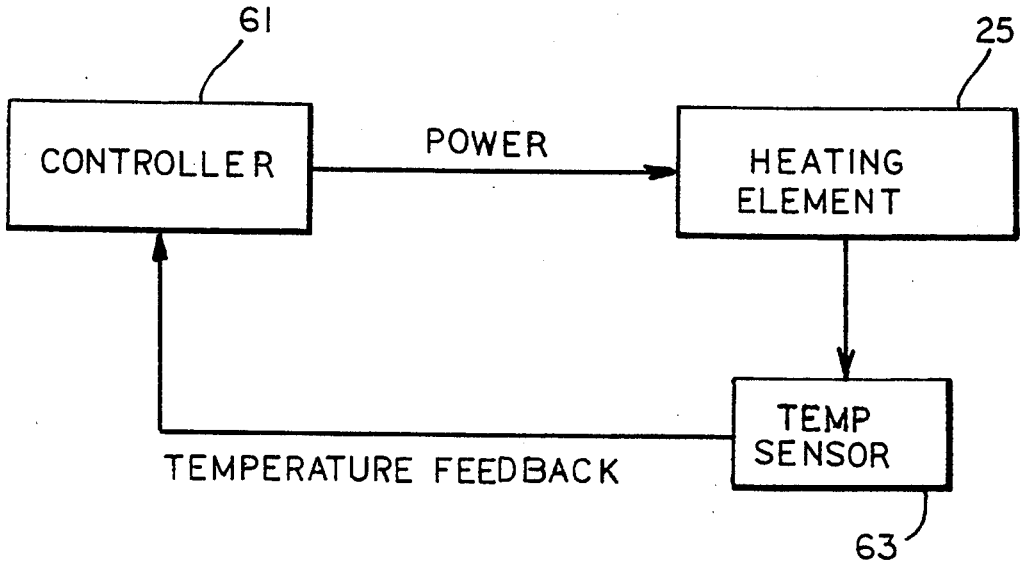
FIG. 7 is a block diagram showing how thermal control is achieved.

FIG. 7 is a block diagram showing my system of for controlling temperature. The control circuit 61 controls the flow of power to heating element 25. The resulting temperature of the barrel 13 of the curling iron 11 is sensed by temperature sensor 63, and a temperature signal is them fed back to the control circuit. The control circuit controls the percentage of the total phase of power which goes to the heating element during each cycle of the power. A lesser percentage of the phase is utilized as the temperature rises, thus providing less heat energy as the temperature rises. Stability is reached at the desired temperature 57.

Figure 8:
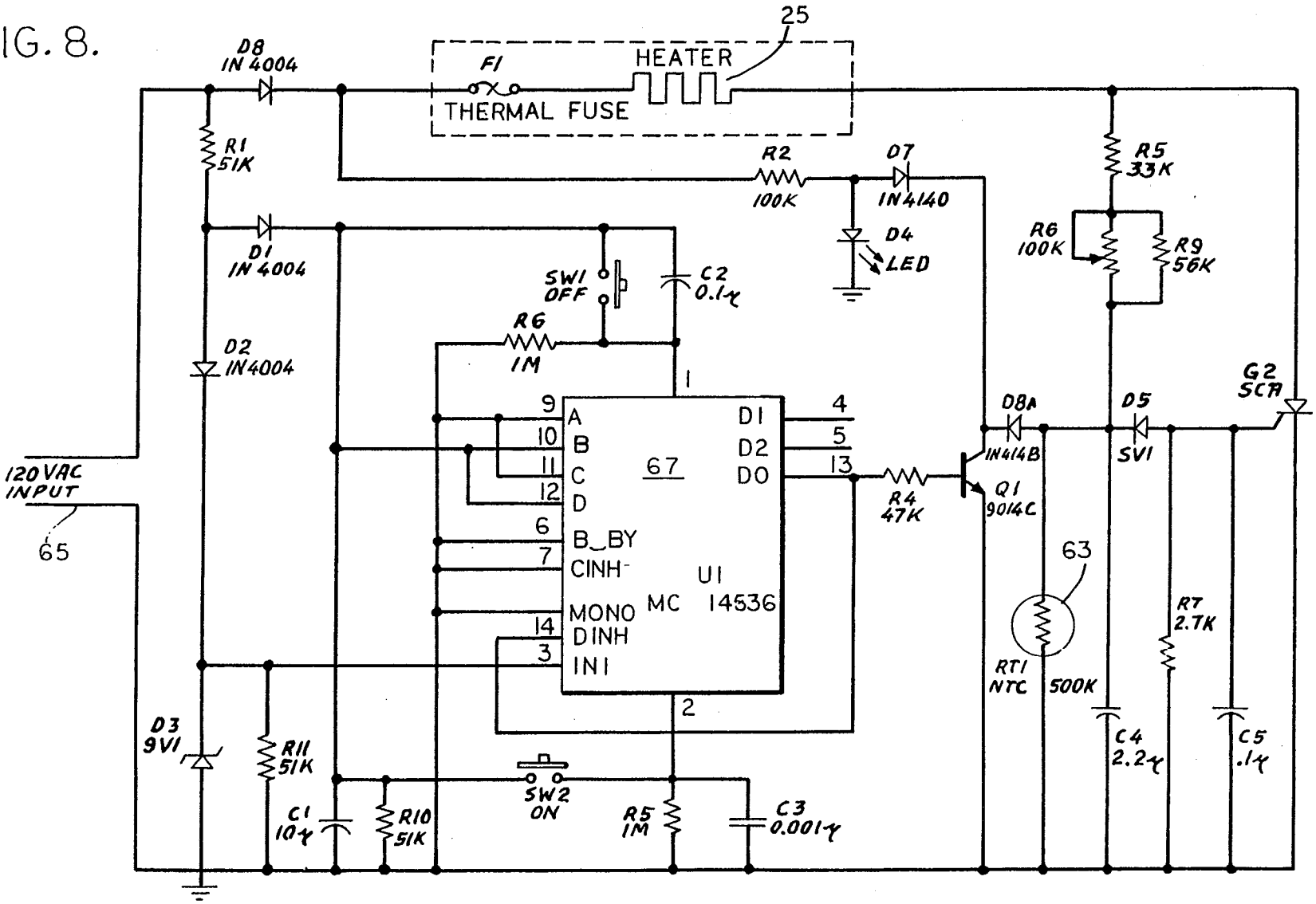
FIG. 8 is a circuit diagram of my temperature control circuit.

Control circuit 61 is shown in FIG. 8 and operates the curling iron on AC power, from source 65, using one-half cycle only. The circuit has the usual on-off switches and rectification; it also has a counting circuit which is a safety device to turn the unit off after a predetermined period. This portion of the circuitry is not part of the invention.

Power for heating element 25 comes from power input 65, is rectified by diode D8, passes through the heating element, and through SCR G2 to ground. The gate of the SCR is controlled by voltage dividing circuit formed of series resistors R5, R9, and RT1 (which is temperature sensor 63), the gate voltage coming from the junction between R9 and RT1.

Temperature sensor 63 is positioned proximate to the heating element 25 inside the barrel. It has a negative temperature coefficient. As the temperature rises, the resistance of the temperature sensor drops, dropping the voltage on the gate of SCR G2. Since the SCR is operating on a half cycle, it turns itself off once each cycle and can be turned on again only when the gate voltage is high enough. Initially, when the unit is first started, it will turn on at or close to the beginning of the half cycle. As the temperature rises, however, the resistance of sensor 63 drops, causing the SCR to turn on later in the cycle, resulting in less power going to the heating element during each cycle. As the temperature approaches the desired temperature, the power supplied approaches that needed to just maintain the desired temperature. This prevents overshoot and avoids ripples. When the desired temperature is reached, the power supplied is just enough to maintain that temperature.

The temperature can be adjusted by varying variable resistor R9. Increasing its resistance, drops the voltage on the gate of the SCR, and, therefore, lowers the temperature, and vice-versa.

The counter circuit 67 controls transistor Q1, which is parallel with temperature sensor 63. When the preset time interval has passed, counter 67 makes Q1 conducting. This grounds sensor 63, so that the gate of the SCR cannot be made conducting.

Accordingly, I have provided a fast heating curling iron which will not overheat.

I claim:

1. A rapidly heating curling iron including a handle, a hollow barrel secured to said handle, said barrel having an inner surface and an inner diameter, a heating element positioned within said barrel, said heating element being an electrical insulating board wound with electrical wire, a pair of heat transmission members, one on each side of said heating element, electrical insulation between said heating element and said heat transmission members, said heat transmission members being shaped and dimensioned such that they fit between said electrical insulation and said inner surface of said barrel and press against a substantial portion of said inner surface, a temperature sensor positioned to sense the temperature of said barrel, and control means operatively associated with said temperature sensor to control said heating element.

2. A rapidly heating curling iron as set forth in claim 1 in which said electrical insulating board includes notched edges and said electrical wire is in the notches of said notched edges.

3. A rapidly heating curling iron as set forth in claim 1 in which said electrical insulation is mica sheeting.

4. A rapidly heating curling iron as set forth in claim 1 in which said heating element is positioned on said inner diameter.

5. A rapidly heating curling iron as set forth in claim 1 in which said heat transmission members each have a substantially semi-circular cross-section.

6. A rapidly heating curling iron as set forth in claim 1 in which said control means is a control circuit, said control circuit causing said heating element to be energized only during one half cycle of supplied AC power, and time control means actuated by said temperature sensor for adjusting the portion of said half cycle which is used, said adjustment being in accordance with the sensed temperature, whereby heat energy from said heating element is rapidly and efficiently transferred to said barrel.

7. A rapidly heating curling iron as set forth in claim 6 in which said control means is an SCR with a gate and said temperature sensor has a negative temperature coefficient and controls said gate.

8. A rapidly heating curling iron as set forth in claim 6 including means for adjusting the desired temperature.

9. In a curling iron having a barrel and a heating element within said barrel, a control circuit to control the power to said heating element, said control circuit including a temperature sensor positioned within said barrel for sensing the temperature of said barrel, a half-wave rectifier to supply half-wave power to said heating element, phase control means for limiting the portion of said half-wave power supplied to said heating element, and said temperature sensor controlling said phase control means.

10. A control circuit as set forth in claim 9 in which said phase control means is an SCR having a gate, said SCR being in series with said heating element, and said temperature sensor has a negative temperature coefficient and controls said gate.

* * * * *